United States Patent [19]

Heinzel et al.

[11] Patent Number: 4,661,155

[45] Date of Patent: Apr. 28, 1987

[54] MOLDED, BORON CARBIDE-CONTAINING, SINTERED ARTICLES AND MANUFACTURING METHOD

[75] Inventors: Volker Heinzel, Linkenheim; Hossein-Ali Keschtkar, Karlsruhe; Ingeborg Schub, Wörth, all of Fed. Rep. of Germany

[73] Assignee: Kernforschungszentrum Karlsruhe GmbH, Karlsruhe, Fed. Rep. of Germany

[21] Appl. No.: 865,477

[22] Filed: May 21, 1986

[30] Foreign Application Priority Data

Jun. 1, 1985 [DE] Fed. Rep. of Germany ..... 3519710
Feb. 18, 1986 [EP] European Pat. Off. ..... 86102025.3

[51] Int. Cl.[4] ..... C22C 29/06

[52] U.S. Cl. ..... 75/237; 75/236; 75/244; 419/17; 419/23; 419/26; 419/28; 419/25

[58] Field of Search ..... 419/17, 23, 26, 28, 419/25; 75/236, 244, 237

[56] References Cited

U.S. PATENT DOCUMENTS

| | | | |
|---|---|---|---|
| 3,178,807 | 4/1965 | Bergmann | 75/236 |
| 3,447,921 | 6/1969 | Chang | 75/236 |
| 4,217,141 | 8/1980 | Schrittwieser | 419/17 |
| 4,320,204 | 3/1982 | Weaver | 419/15 |
| 4,557,893 | 12/1985 | Jatkar et al. | 419/17 |

OTHER PUBLICATIONS

Kieffer, R. K. and Schwarzkopf, P., Hartstoffe und Hartmetalle Springer-Verlag, 1953.

*Primary Examiner*—Stephen J. Lechert, Jr.
*Attorney, Agent, or Firm*—Spencer & Frank

[57] ABSTRACT

A molded, boron carbide-containing, sintered article which includes at least 65 percent by volume boron carbide; and from 5 to 35 percent by volume of at least one binder metal selected from the group consisting of molybdenum, molybdenum alloys, tungsten and tungsten alloys, having a melting point above 1,800° C., and forming no molten borides or carbides within a temperature range of from 1,800° to 1,950° C. A method for producing the article includes the steps of mixing to obtain a homogeneous mixture from 20 to 80 percent by weight boron carbide particles having a particle size ranging from 1 to 1,650 microns with up to 80 percent by weight of particles of the at least one binder metal having a particle size ranging from 35 to 100 microns; introducing the homogeneous mixture into a graphite matrix mold; heating to sinter the homogeneous mixture at a temperature ranging from 1,800° to 2,000° C. for a predetermined heating time in a protective gas atmosphere to provide a sintered article; compressing the sintered article while hot in a protective gas atmosphere at a pressure ranging from 100 to 300 N/mm$^2$ for a pressing time ranging from 5 to 20 minutes to provide the molded, sintered article; and cooling the molded, sintered article to ambient temperature at a cooling rate ranging from 100° to 200° C./min for a predetermined cooling time; provided that the sum of the heating time and the cooling time does not exceed the pressing time.

9 Claims, No Drawings

MOLDED, BORON CARBIDE-CONTAINING, SINTERED ARTICLES AND MANUFACTURING METHOD

BACKGROUND OF THE INVENTION

1. Field of the Invention

The present invention relates to a very hard and tough molded article for working metals, hard metals, ceramics and glasses. The molded article is sintered and made of boron carbide and a binder metal.

2. Background of the Art

Boron carbide is particularly resistant to sand blasting, a fact suggesting certain uses for boron carbide-containing sintered articles. Heretofore, however, such sintered articles were characterized by low resistance to breakage. For example, Kieffer, R. K. and Schwarzkopf, P., *Hartstoffe und Hartmetalle* [Hard Substances and Hard Metals], published by Springer-Verlag, 1953, compared wear values of hard metals and hard substances determined according to the sand blasting method on pages 524 and 525. The wear value of a sintered article containing 95% weight percent boron carbide ($B_4C$), i.e., 20 weight % C, and 5 weight % iron was the lowest reported in the comparison thereof with sintered articles made of tungsten carbide-cobalt (WC-Co), titanium carbide-iron-chromium (TiC-Fe-Cr) and titanium carbide-vanadium carbide-iron-nickel (TiC-VC-Fe-Ni). Further, page 327 of the publication reported that attempts at binding $B_4C$ with tough metals had failed.

Further, if $B_4C$ particles are mixed with powders of known binder metals cobalt (Co) or nickel (Ni), sintering thereof is known to result in undesirable chemical reactions and the formation of unwanted phases therein, for example, boride phases. The different physical characteristics between the already existing phases and the newly developed phases frequently produce cracks and gaps in the molded article as early as during cooling.

SUMMARY OF THE INVENTION

It is an object of the present invention to provide molded articles made of sintered $B_4C$-containing mixtures which have greater strength, particularly greater toughness, than molded articles made of pure, sintered $B_4C$ and which are particularly well suited for use in cutting or grinding tools or for uses in which mechanical wear stresses or high aeriel pressures are encountered as in nozzles. Articles, such as small cutting plates for machining work are desired, as well as molded articles serving as tools for grinding, sharpening, rubbing etc. of metals, particularly nonferrous metals, hard metals, ceramics and glasses.

It is another object of the invention to make available a simple method for manufacturing such molded articles.

These objects are accomplished by the present invention with a molded, boron carbide-containing, sintered article which includes at least 65 percent by volume boron carbide; and from 5 to 35 percent by volume, preferably from 10 to 15 percent by volume, of at least one binder metal selected from the group consisting of molybdenum, molybdenum alloys, tungsten and tungsten alloys, having a melting point above 1,800° C., and forming no molten borides or carbides within a temperature range of from 1,800° to 1,950° C. Further, the boron carbide may be doped by including activated carbon in the article in an amount ranging from a finite amount up to 2.0 percent by weight, based on the weight of the article.

These objects are also accomplished by providing a method for producing the molded, sintered article according to the invention which includes the steps of mixing to obtain a homogeneous mixture from 20 to 80 percent by weight, based on the weight of the article, of boron carbide particles which have a particle size ranging from 1 to 1,650 microns with up to 80 percent by weight, based on the weight of said article, of particles of at least one binder metal selected from the group consisting of molybdenum, molybdenum alloys, tungsten and tungsten alloys, which have a particle size ranging from 35 to 100 microns, which have a melting point above 1,800° C., and which form no molten borides or carbides within a temperature range of from 1,800° to 1,950° C.; introducing the homogeneous mixture into a graphite matrix mold; heating to sinter the homogeneous mixture at a temperature ranging from 1,800° to 2,000° C. for a predetermined heating time in a protective gas atmosphere, such as an atmosphere provided by an inert, i.e., non-reactive gas, to provide a sintered article; compressing the sintered article while hot in a protective gas atmosphere, at a pressure ranging from 100 to 300 $N/mm^2$ for a pressing time ranging from 5 to 20 minutes to provide said molded, sintered article; and cooling the molded, sintered article to ambient temperature at a cooling rate ranging from 100° to 200° C./min for a predetermined cooling time; provided that the sum of the heating time and the cooling time does not exceed the pressing time.

Mo and W belong to the group of metals having a low heat of formation for their respective borides, as well as for their respective carbides. The lowest melting point of a Mo boride is 1,950° C., corresponding to $0.75.T_{MP}$ of Mo, which lies within the sintering range of Mo. A liquid phase reacting rapidly with $B_4C$ has to be avoided in order to maintain a phase with a hardness remarkably below that one of $B_4C$ acting by that as a binder for the brittle $B_4C$. Liquid Mo borides occur at 1950° C. composed either as an eutectic from $Mo+Mo_2B$ or as an eutectic from $Mo_2B_5+MoB_{12}$.

In order to obtain a fine-grained, sintered material, the $B_4C$ is doped with activated carbon. For this purpose, the homogeneous mixture additionally includes from a finite amount up to 2.0 percent by weight of activated carbon, preferably from 0.1 to 2.0 percent by weight, based on the weight of the molded article. The sintering temperature for $B_4C$ mixtures doped with activated carbon lies in the vicinity of the upper value of the sintering temperature range of 1,800° to 2,000° C.

The homogeneous mixture may alternately be compacted prior to being introduced into the graphite matrix mold. If prepressing compaction of the homogeneous mixture is performed prior to introduction thereof into the graphite matrix mold, the compacted body may then be preheated to the sintering temperature which ranges from 1,800° to 2,000° C. for a predetermined preheating time. The total heating time then includes the preheating time.

Hot pressing of these $B_4C$ binder metal powder mixtures takes place at temperatures at which both materials are compacted, but for which no liquid melt phase occurs. A significant feature of the method according to the invention is the relatively short duration of the hot pressing step, i.e., from 5 to 20 minutes, in which a small percentage of the binder metal particulates in the homogeneous mixture remain in the molded, sintered article as a metallic phase and embeds or encases the $B_4C$ particles. A reaction forming borides takes place, but the procedure is conducted in order to maintain the metallic phase as much as possible.

The compressing step may be accomplished by applying pressure to the sintered article, continuously or discontinuously, such as by repeatedly impacting the sintered article. Preferably, the sintered article is maintained within the sintering temperature range during the compressing step, and heating to sinter and compressing take place simultaneously. When compression is discontinuous, the pressing time is measured by the time under compression.

The molded, sintered article may be removed from the graphite matrix mold when hot, that is, prior to the subsequent cooling step. Alternately, cooling may take place in the graphite matrix mold followed by recovery of the finished article from the mold.

DESCRIPTION OF THE PREFERRED EMBODIMENTS

Molded articles have been produced which were composed of the following: 5 percent by volume Mo (corresponding to 20 percent by weight) and 95 percent by volume $B_4C$ (corresponding to 80 percent by weight); 10 percent by volume Mo and 90 percent by volume $B_4C$; 15 percent by volume Mo and 85 percent by volume $B_4C$; and 35 percent by volume Mo (corresponding to 80 percent by weight) and 65 percent by volume $B_4C$ (corresponding to 20 percent by weight).

Polished cross-sections of the molded articles produced according to the invention clearly showed encasement of $B_4C$ particles by the Mo binder metal. The separation between the embedded $B_4C$ particles and the surrounding Mo region was seen from the dark appearance of the $B_4C$ particles and the light appearance of the Mo phase surrounding same. These differences were confirmed in photographs taken through a raster electron microscope and by a radiographic scan of the same region. The metallic Mo in the molded articles can be detected by means of an X-ray, fine-structure analysis. The unequivocal separation of $B_4C$ containing regions and Mo containing intermediate layers or regions having thicknesses down to 3 $\mu$m has been demonstrated.

Molded, sintered articles according to the invention and composed of from 5 to 35 percent by volume of Mo, i.e. from 20 to 80 percent by weight, and the remainder $B_4C$ were prepared and tested as follows:

Powders of Mo and $B_4C$ having particle size ranges of from 37 to 140 microns and of from 1.0 to 1,360 microns, respectively, were weighed and homogeneously mixed and were filled into a graphite matrix mold.

The mixed powders were compacted and sintered at 1850° C. to 2000° C. in a semi-isostatic hot press having two punches (dies) moving from opposite sides into a free floating matrix mold.

Compressing the mixed powders under a pressure from 10–30 MPa and at temperatures from 1,850°–2,000° C., small plates were sintered having rectangular and round shapes.

Compressive molding took place with heating rates between 100° and 200° C./min and holding periods between 10 and 20 minutes. The plates were cooled at cooling rates ranging from 100°–200° C./min, followed by removal thereof from the mold.

The molded plates produced in this manner were clamped into a tool holder and were fastened in steel mounts in a lathe for use, each in turn, as cutting plates. Various steels, including austenites, were machined by means of these cutting plates.

The wear resistance of these plates was optically compared with that of a conventional, reversible cutting plate made of a hard substance coated with titanium nitride (TiN). The wear resistance of the molded plates according to the invention containing 10 and 15 percent by volume Mo, respectively, was observed to be much better than that for the conventional plate. Samples with lower Mo percentage showed more break aways increasing with decreasing Mo content. With a Mo content beyond 15 % by volume the wear resistance decreases, and product samples with about 35 % by volume Mo have a wear resistance below that of conventional plates in comparison.

The same lathe arrangement was used to work $Al_2O_3$. The plates according to the invention removed material over a large area and performed cuts. Additionally, tantalum carbide (TaC) and titanium nitride (TiN) surfaces could be removed by the inventive plates. Pure sintered $B_4C$-plates are so brittle that the cutting rims split off immediately when used for cutting, in contrast to the mold articles sintered according to the invention.

Carbon doping with a commercially avaible activated carbon caused smaller grain sizes of the sintered articles, which should cause better wear resistance.

It will be understood that the above description of the present invention is susceptible to various modifications, changes and adaptations, and the same are intended to be comprehended within the meaning and range of equivalents of the appended claims.

What is claimed is:

1. A molded, boron carbide-containing, sintered article, comprising:

at least 65 percent by volume boron carbide; and from 5 to 35 percent by volume of at least one binder metal selected from the group consisting of molybdenum, molybdenum alloys, tungsten and tungsten alloys, having a melting point above 1,800° C., and forming no molten borides or carbides within a temperature range of from 1,800° to 1,950° C.

2. The article according to claim 1, further comprising from a finite amount up to 2.0 percent by weight activated carbon, based on the weight of said article.

3. The article according to claim 1, wherein said at least one binder metal is present in an amount ranging from 10 to 15 percent by volume.

4. A method for producing the molded, boron carbidecontaining, sintered article according to claim 1, the method comprising:

mixing to obtain a homongeneous mixture from 20 to 80 percent by weight, based on the weight of said article, of boron carbide particles having a particle size ranging from 1 to 1,650 microns with up to 80 percent by weight, based on the weight of said article, of particles of at least one binder metal selected from the group consisting of molybdenum, molybdenum alloys, tungsten and tungsten alloys, which have a particle size ranging from 35 to 100 microns, which have a melting point above 1,800° C., and which form no molten borides or carbides in a temperature range of from 1,800° to 1,950° C.;

introducing said homogeneous mixture into a graphite matrix mold;

heating to sinter said homogeneous mixture at a temperature ranging from 1,800° to 2,000° C. for a predetermined heating time in a protective gas atmosphere to provide a sintered article;

compressing said sintered article while hot in a protective gas atmosphere at a pressure ranging from 100 to 300 $N/mm^2$ for a pressing time ranging from 5 to 20 minutes to provide said molded, sintered article; and cooling said molded, sintered article to ambient temperature at a cooling rate ranging from 100° to 200° C./min for a predetermined cooling time;

provided that the sum of the heating time and the cooling time does not exceed the pressing time.

5. The method according to claim 4, wherein said homogeneous mixture additionally includes from a finite amount up to 2.0 percent by weight activated carbon, based on the weight of said article.

6. The method according to claim 5, wherein said homogeneous mixture additionally includes from 0.1 to 2.0 percent by weight activated carbon.

7. The method according to claim 5, including the further step of removing said molded, sintered article from said graphite matrix mold prior to the cooling step.

8. The method according to claim 4, wherein the compressing step is discontinuous and includes repeatedly impacting said sintered article.

9. The method according to claim 4, including the further step of removing said molded, sintered article from said graphite matrix mold prior to the cooling step.

* * * * *